US007404724B1

(12) United States Patent
Miller

(10) Patent No.: US 7,404,724 B1
(45) Date of Patent: Jul. 29, 2008

(54) CONNECTOR WITH ESD INHIBITING SHELL

(76) Inventor: Robert Dennis Miller, 12500 Monaghan Trl., Austin, TX (US) 78727-5230

( * ) Notice: Subject to any disclaimer, the term of this patent is extended or adjusted under 35 U.S.C. 154(b) by 528 days.

(21) Appl. No.: 10/817,711

(22) Filed: Apr. 2, 2004

(51) Int. Cl.
*H01R 13/53* (2006.01)

(52) U.S. Cl. ..... 439/181; 439/108; 439/607; 439/886

(58) Field of Classification Search ..... 439/181, 439/101, 108, 607, 620, 886
See application file for complete search history.

(56) References Cited

U.S. PATENT DOCUMENTS

| | | | | |
|---|---|---|---|---|
| 4,747,783 | A * | 5/1988 | Bellamy et al. | 439/181 |
| 4,824,377 | A | 4/1989 | De Burro | |
| RE35,896 | E * | 9/1998 | Brunker et al. | 439/108 |
| 6,259,170 | B1 * | 7/2001 | Limoge et al. | 439/490 |
| 6,461,169 | B1 | 10/2002 | Harrison et al. | |
| 6,595,801 | B1 | 7/2003 | Leonard et al. | |
| 6,672,887 | B1 | 1/2004 | Yu | |

OTHER PUBLICATIONS

Dahman, Sam J. Recent Innovations of Inherently Conducting Polymers for Optimal ESD Protection Materials. Presented at EOS/ESD Symposium. Portland. OR, Sep. 9-13, 2001.
Freedonia Group Conductive Polymers. Mindbranch Jul. 2002 R154-572.

* cited by examiner

*Primary Examiner*—F. O. Figueroa
(74) *Attorney, Agent, or Firm*—Scheinberg & Griner, LLP; Michael O. Scheinberg

(57) ABSTRACT

ESD damage caused by connecting devices that have separate grounds, is reduced by equalizing the charge on the first and second device grounds before connecting their signal lines together; but when the grounds are equalized, the transfer of charge between them is sufficiently slowed down so as to avoid harming components within the device receiving the extra charge. In one embodiment, a connector for connection with a complementary connector is provided with an inhibited shell. The inhibited shell is mounted to the connector body for connection with a shell on a complementary connector. The inhibited shell is configured (e.g., with a conductive polymer having a desired resistance) to sufficiently slow down the detrimental transfer of charge between the separate grounds on the connected devices while at the same time allowing them to equalize with one another.

26 Claims, 2 Drawing Sheets

CONNECTOR WITH ESD INHIBITING SHELL

TECHNICAL FIELD OF THE INVENTION

The present invention relates generally to electrical connectors. In particular, it relates to a connector with an ESD inhibiting shell.

BACKGROUND OF THE INVENTION

Electrical connectors are used in a wide variety of applications. Some connectors simply transmit power (e.g., from a power source to an appropriate appliance) or signal lines to printed circuit boards, other electronic devices or to other complementary connectors. Other connectors transmit both power and signal lines through the connector interface.

Some electrical connectors also employ various types of shell structures, ground structures or the like to protect or to electrically interact with the transmission lines and their terminals within the connectors. For instance, some connectors are provided with shell structures to protect against electrostatic discharges (ESD) which are generated when the connector comes into contact with another conductive body which may be a complementary mating connector. In essence, the ESD shell is used to dissipate static charges. Connectors also may have shell structures to protect against electromagnetic interference (EMI). In essence, the EMI shell protects the electrical circuitry from externally generated radiated emissions as well as preventing electromagnetic interference from radiating outwardly of the connector. Such shell configurations can work well, especially once a connector is engaged with its complementary connector. Unfortunately, however, in connectors where shells from complementary connectors initially come into contact with each other when their connectors are engaged, it is observed that ESD may continue to damage components in one or both of the connecting devices.

Accordingly, what is needed is an improved connector configuration.

SUMMARY OF THE INVENTION

The present invention provides a method for reducing ESD damage to devices, which have separate grounds, when they are connected to one another. The charge on the first and second device grounds are equalized when the devices are connected to one another before connecting their signal lines together; but when the grounds are equalized, the transfer of charge between them is sufficiently slowed down so as to avoid harming components within the device receiving the extra charge. In one embodiment, a connector for connection with a complementary connector is provided with an inhibited shell. The inhibited shell is mounted to the connector body for connection with a shell on a complementary connector. The inhibited shell is configured (e.g., with a conductive polymer having a desired resistance) to sufficiently slow down the detrimental transfer of charge between the separate grounds on the connected devices while at the same time allowing them to equalize with one another.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiment disclosed may be readily utilized as a basis for modifying or designing other structures for carrying out the same purposes as the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, the following description is made with reference to the accompanying drawings, in which.

DETAILED DESCRIPTION OF THE PREFERRED EMBODIMENTS

Figure 1:
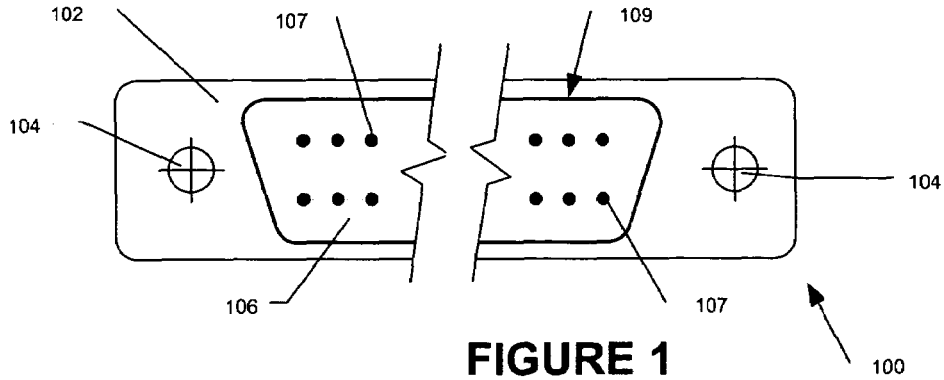
FIGURE 1 (PRIOR ART)
FIG. 1 is a diagram of a male connector portion from a conventional connector assembly.

FIG. 1 shows a conventional connector 100 that can be connected to a complementary connector (not shown). Connector 100 has a dielectric body 106 with signal (and possibly power) contacts 107 contained there within for connection with corresponding contacts in a complementary connector. It also includes a mount bracket 102, with mounting screws 104, along with a metal shell 109, which serves to protect signal lines connected to contacts 107 from electrostatic discharge ("ESD").

Figure 2:
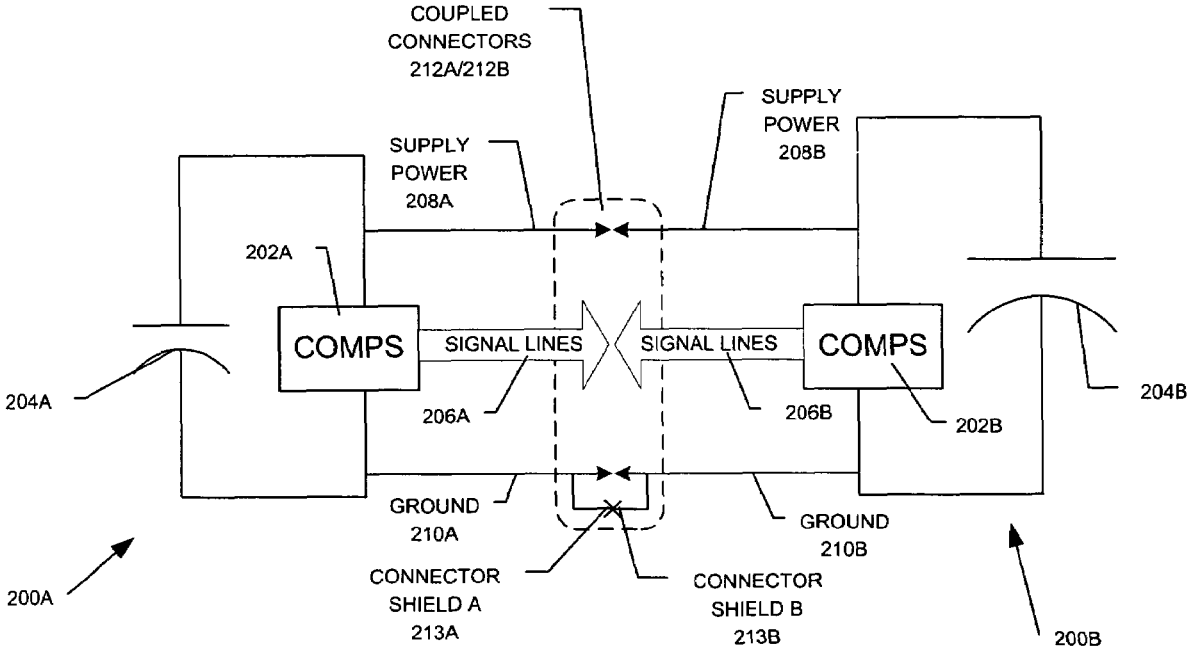
FIGURE 2 (PRIOR ART)
FIG. 2 is a schematic diagram of two components connected together with the connector of FIG. 1.

FIG. 2 is a schematic diagram of first and second devices, 200A and 200B, connected together through a pair of complementary connectors 212A and 212B. This circuit generally models the devices, 200A and 200B, from a static discharge standpoint when they are connected with each other. (The first circuit 200A is represented with a "COMPONENTS" block 202A connected in parallel with a capacitor 204A. Likewise, the second circuit 200B has a "COMPONENTS" block 202B connected in parallel with capacitor 204B.

The first and second devices, 200A and 200B, could be any device that is connected to another device through a coupled connector pair. Such devices include but are not limited to desktop and portable computers, PDAs, computer peripheral devices, measurement instruments, consumer and industrial appliances and the like. Such devices typically have components (202) connected in parallel between system supply and ground planes, which are modeled by the capacitors, 204A and 204B. (Supply and ground planes, taken together, are generally capacitive in nature and in fact, usually have capacitors connected across them, e.g., to provide localized supply noise decoupling.) The components blocks, 202A and 202B, represent the various components in devices that are connected between the supply and ground planes. Such components could include, for example, IC components, main and sub power supplies, functional modules, and the like. Each device has a connector (212A/B) that connects signal lines, 206A/B, along possibly with supply lines, 208A/B and Ground lines, 210A/B, to the other device. Also represented are shell elements, 213A and 213B, which are each connected to their associated device's ground and to each other when the connectors, 212A and 212B, are coupled together.

When the connectors are engaged with each other, contact is initially made by the shells. The reason for causing the shell elements to make contact before the signal lines is to equalize the separate device grounds before the signal lines are connected together. This is important because under certain circumstances, the grounds, 210A and 210B can actually have significantly different charge and/or voltage levels. One example of such a circumstance is when one of the devices is grounded to earth ground (i.e., it is "plugged into a wall"), while the other device ground is allowed to float (as with a portable device). For example, when a scanner, plugged into an outlet, is connected to a laptop computer that is not powered through an adaptor.

Unfortunately, even though the shells make contact, thereby equalizing the device grounds, before the signal lines are connected, it is observed that device components, in some cases, continue to be damaged from ESD. While it is not exactly understood why this happens, it is believed that this occurs as a result of the sudden, overwhelming charge transfer from the "high" ground to the "low" ground, which continues on to the "low" device's capacitive supply/power planes and across at least some of its components. The spike transmitted at the "low" devices' capacitive supply/ground planes will not necessarily be proportional to the actual charge difference between the ground planes, but it may still be great enough to damage some of the more sensitive components. Accordingly, if measures are taken to slow down (or inhibit) charge transfer from the "high" ground to the "low" ground, the damaging spike can be avoided, while at the same time, the objective of equalizing the two device grounds is achieved, albeit in a longer amount of time, e.g., mill-seconds rather than micro-seconds.

Figure 3:
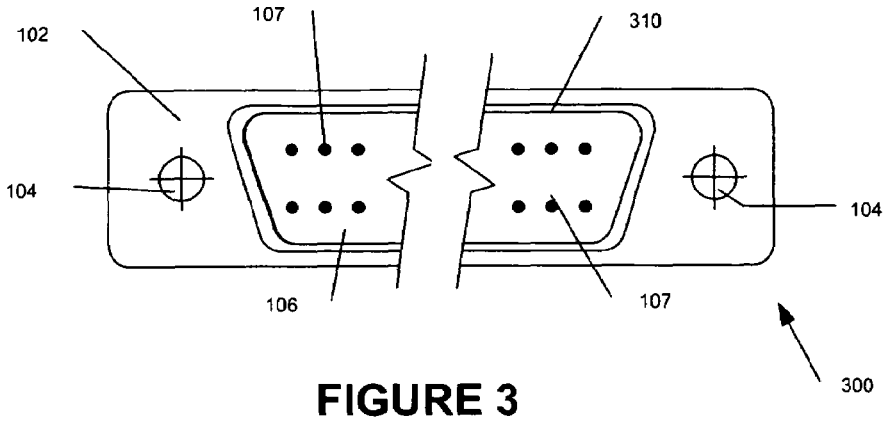
FIG. 3 is a diagram of a male connector portion from a connector assembly embodiment of the present invention.
Figure 4:
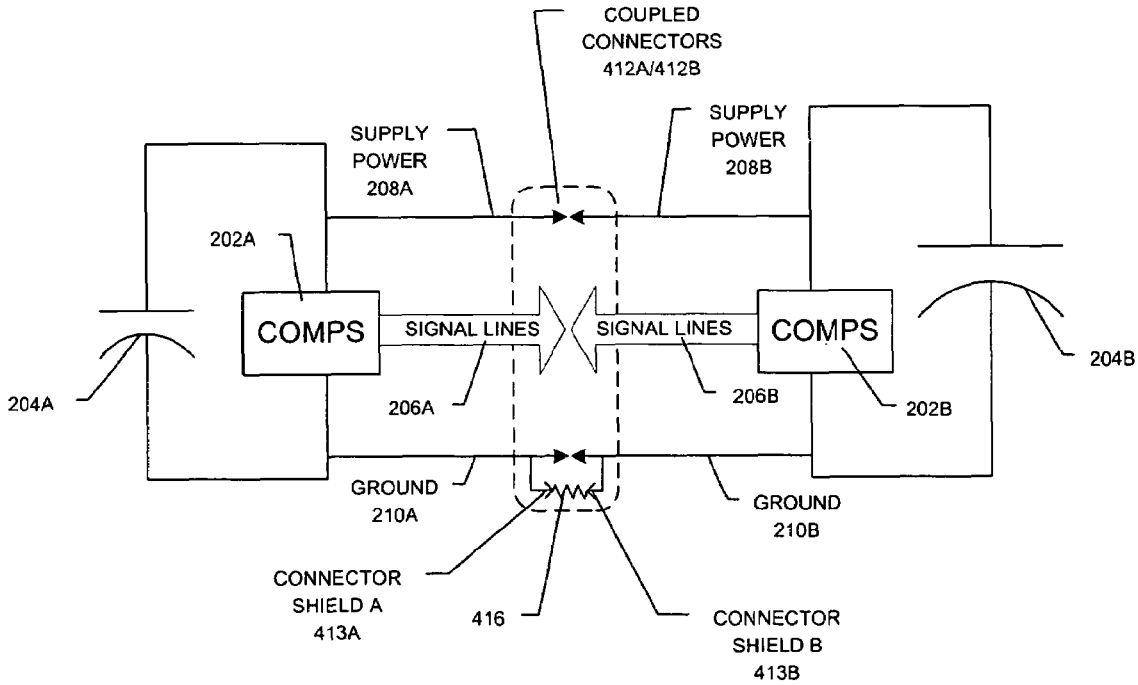
FIG. 4 is a schematic diagram of the two connected devices from FIG. 2 but with the connector of FIG. 3.

FIGS. 3 and 4 show one embodiment of a connector 300 that appears to solve the ESD problem discussed above. Connector 300 is the same connector as connector 100 of FIG. 1 except that it has an inhibited shell 310. For purposes of this disclosure, an "inhibited shell" is the part of a connector that (1) makes contact with a corresponding part from a complementary connector to equalize the separate device grounds, and (2) is configured to inhibit (or slow down) the transfer of charge between the device grounds, at least when the shells initially make contact with each other. (As used herein, the term: "shell" is used broadly to cover the part of a connector that makes contact with a corresponding part from a complementary connector to equalize the separate device grounds and does not necessarily require the part to encompass or shield the signal contacts such as from EMI.) In this embodiment, inhibited shell 310 is partially covered with a resistive coating where it initially makes contact with a shell from the complementary connector. The remaining part of the shell (that makes contact with the other shell) is left uncoated thereby allowing a "hard" (conductive) connection to ultimately be made between the shells once they are completely connected. In this way, when the shells initially make contact with each other, charge transfer occurs but at an inhibited rate. Once the connectors are fully connected, however, they make full conductive contact with each other to provide a conductive connection between the separate device grounds while the devices are connected to each other in operation. The resistive coating provides a desired resistance between the two shells to sufficiently slow down ground equalization charge but is small enough to allow for a sufficient amount of charge transfer to occur before the hard connection is made.

The circuit diagram of FIG. 4 is the same as that discussed for FIG. 2 except that it uses a connector such as connector 300, with an inhibited shield, instead of connector 100. Similar parts are similarly numbered, but the circuit further includes an additional resistor element 416, interposed between shell elements 413A and 413B, for modeling the inhibited shell of coupled connectors 412A/412B. In one embodiment, the resistive coating on shell 310 (from connector 300) is configured to create a ground-to-ground resistance of about 100K ohms between the two shell elements when contact is initially made. Persons of skill will recognize that a suitable resistive value will vary from application to application depending on particular design parameters. Likewise, the ground-to-ground resistance will depend on various structural and material factors including shell or shell coating properties, the surface area of the resistive coating where contact is made, and the thickness of the resistive coating where contact is made. Also, in embodiments with only part (the part making initial contact) of the shell having a resistive coating but left uncoated in other parts of the shell that makes contact with the other shell, higher or lower resistances may be desired depending on how much shell-to-shell contact occurs through the resistive coating.

Returning back to FIG. 3, shell 310 comprises a conventional metal shell that is at least partially coated with a resistive coating to provide a desired resistance for slowing down charge transfer. (The term: "resistive", as used herein, is intended to refer to a conducting, non-insulating resistance suitably high, e.g., in the range between 1K and 10M ohms, to sufficiently slow down charge transfer while allowing the separate grounds to equalize in a reasonable amount of time.) Any suitable material can be used to implement the resistive coating (or shell for that matter). For example, suitable materials include but are not limited to conductive paints, conventional plastics (filled with conductive fillers), thermoplastic polymer blends with inherently conductive polymers ("ICPs"), and inherently dissipative polymers ("IDPs"). ICPs have been developed in polypropylene, polyethylene, and polystyrene. The main advantages of these materials are the ability to provide optimal and tunable ESD protection into the $10^6$ to $10^9$ ohms/inch2 range with reasonable thermal stability, additional color options, mechanical properties similar to matrix resin, and processing ease. Other suitable ICP candidates include polythiophenes, polypyrroles, and polyanilines. IDPs are another class of controllably resistive materials that are generally well suited for most connector environments. Depending upon the particular environment and connector configuration, different materials will be better suited than others. Desired characteristics for physical parameters such as hardness, friction, resistive uniformity, reliability, stability, and conductivity may be different in value and priority depending on the particular inhibited shell configuration and connector application.

Although the present invention and its advantages have been described in detail, it should be understood that various changes, substitutions and alterations can be made herein without departing from the spirit and scope of the invention as defined by the appended claims. For example, other inhibited shell configurations could include a conventional shell connected to its device ground through a resistor, or a shell wholly made from a suitably resistive material.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

I claim as follows:

1. A connector for making an electrical connection, comprising:

a dielectric housing;

multiple contacts positioned in the dielectric housing; and a conductive shell at least partially surrounding the dielectric housing, the conductive shell having thereon a resistive layer providing electrical resistance to prevent a surge of current through the shell as the shell contacts another conductor.

2. The connector of claim 1 in which the resistive layer is positioned so that it is the first portion of the connection to contact a mating connector first.

3. A connector for connection with a complementary connector, said connector and complementary connectors adapted to each be mounted to a separate device having a ground, said connector comprising:

a dielectric body having a plurality of signal contacts; and an inhibited shell mounted to said body for connection with a shell on the complementary connector, the inhibited shell being configured to sufficiently slow down a transfer of charge between the connector and complementary connector device grounds to prevent charge transfer damage when the connectors are connected with one another.

4. The connector of claim 3, wherein the inhibited shell is made from an inherently conductive polymer material.

5. The connector of claim 3, wherein a resistive element is mounted between the inhibited shell and a part of the connector that connects to its device ground.

6. The connector of claim 3, wherein the inhibited shell comprises a resistive coating.

7. The connector of claim 6, wherein the resistive coating is made from an inherently conductive polymer material.

8. The connector of claim 6, wherein the resistive coating partially covers the inhibited shell.

9. The connector of claim 8 in which the resistive coating covers the leading edge of the shell.

10. The connector of claim 6 in which the inhibited shell is configured to sufficiently slow down the transfer of charge between the connector and complementary connector device grounds to prevent charge transfer damage caused by electrostatic discharge when the connectors are connected with one another.

11. The connector of claim 10 in which the conductive shell includes a conductive polymer over a portion of a metallic shell.

12. The connector of claim 10 in which the shell is grounded.

13. The connector of claim 6 in which the resistive coating provides a resistance of greater than 1,000 ohms.

14. The connector of claim 6 in which the resistive coating has a resistivity of greater than $10^6$ ohms per square inch.

15. The connector of claim 6 in which the inhibited shell includes a resistive coating on the leading edge of the shell.

16. A first device having a connector for connection to a second device through a complementary connector, the first and second devices each having a separate ground, said first device connector comprising:

a dielectric body having a plurality of signal contacts; and an inhibited shell mounted to said body for connection with a shell on the complementary connector, the inhibited shell being configured to sufficiently slow down a transfer of charge between the first and second device grounds to prevent charge transfer damage when the connectors are connected with one another.

17. The first device of claim 16, wherein the inhibited shell comprises a resistive coating.

18. The first device of claim 17, wherein the resistive coating is made from an inherently conductive polymer material.

19. The first device of claim 17, wherein the resistive coating partially covers the inhibited shell.

20. The first device of claim 16, wherein the inhibited shell is made from an inherently conductive polymer material.

21. The first device of claim 16, wherein a resistive element is mounted between the inhibited shell and a part of the first device connector that connects to the first device ground.

22. The connector of claim 21 in which the resistive element is mounted on the portion of the inhibited shell that is positioned to first contact the second device.

23. The first device of claim 16, wherein the first and second devices comprise a portable computing device and a peripheral device.

24. The first device of claim 16 in which the inhibited shell is configured to sufficiently slow down the transfer of charge between the first and second device grounds to prevent charge transfer damage from electro static discharge when the connectors are connected with one another.

25. The first device of claim 16 in which the resistive coating provides a resistance of greater than 1,000 ohms.

26. The first device of claim 16 in which the resistive coating provides a resistivity of greater than $10^6$ ohms per square inch.

* * * * *